United States Patent [19]

Stone

[11] 4,123,320

[45] Oct. 31, 1978

[54] WATER CONTROL SYSTEM INCLUDING A PRESSURE ROLL FOR SUCTION ROLLS IN PAPERMAKING MACHINES

[75] Inventor: Fred T. Stone, West Monroe, La.

[73] Assignee: Olinkraft, Inc., West Monroe, La.

[21] Appl. No.: 538,933

[22] Filed: Jan. 6, 1975

[51] Int. Cl.[2] ..... D21F 3/10

[52] U.S. Cl. ..... 162/199; 162/217; 162/274; 162/306

[58] Field of Search ..... 162/199, 210, 211, 217, 162/274, 305, 306, 307, 314, 351, 370, 372, DIG. 7, 203, 301; 210/404; 29/122, 132

[56] References Cited

U.S. PATENT DOCUMENTS

| | | | |
|---|---|---|---|
| 1,590,875 | 6/1926 | Barlow et al. | 162/314 |
| 2,429,689 | 10/1947 | Hornbostel | 162/DIG. 7 |
| 3,111,454 | 11/1963 | Tucker et al. | 162/370 X |
| 3,902,960 | 9/1975 | Zentner et al. | 162/199 |

FOREIGN PATENT DOCUMENTS

| | | | |
|---|---|---|---|
| 374,749 | 4/1923 | Fed. Rep. of Germany | 162/274 |

*Primary Examiner*—Richard V. Fisher
*Attorney, Agent, or Firm*—Norvell E. Von Behren; C. Emmett Pugh

[57] ABSTRACT

The use of a pressure roll in a water control system for suction rolls generally and couch rolls particularly for a papermaking process of the type wherein water is removed from the wet paper web that has been run around the roll and wherein a surface tension covering is provided around the periphery of the couch roll on at least a portion of the couch roll and a water control zone is provided within the couch roll to control the water removed from the paper to the surface tension member with variations of the pressure within the water control zone to directionally control the discharge of water off the couch roll in a predetermined pattern for deposit in the water collecting pan provided in proximity to the couch roll.

The pressure roll, having a new soft rubber covering, is mounted in face-to-face pressure engagement against the couch roll, with the pressure nip therebetween located in the water collecting zone preferably within one to one-and-a-half inches of the beginning of the water collecting zone. The pressure roll serves to counteract the natural tendency of the pulp fines to plug up the interstices of the wire mesh screen covering on the couch roll which would cause the water removal and water control action of the couch roll to be hampered.

18 Claims, 6 Drawing Figures

WATER CONTROL SYSTEM INCLUDING A PRESSURE ROLL FOR SUCTION ROLLS IN PAPERMAKING MACHINES

REFERENCE TO RELATED APPLICATIONS

This application is directed to an improved modification of the system disclosed in prior copending application Ser. No. 483,649 entitled "Water Control System for Suction Rolls In Papermaking Machines" filed June 28, 1974, now U.S. Pat. No. 3,902,960 issued Sept. 2, 1975 which was a continuation-in-part of Ser. No. 285,108 entitled "Improved Suction Roll and Method of Water Removal" filed Aug. 30, 1972, now abandoned. Both of the foregoing patent applications, filed by Thomas G. Zentner et al., as well as the present one are assigned to Olinkraft, Inc. (a Delaware corporation).

BACKGROUND OF THE INVENTION

This invention relates generally to the papermaking process and more particularly to a new and novel suction roll/pressure roll combination and suction roll water removal system used in the papermaking process for removing water at for example the couch roll of the process. Because the present invention has particular but not exclusive application to couch rolls, the present invention will be primarily discussed and disclosed with respect to the couch roll art. The present invention has specific application in papermaking machines of the "Verti-Forma" and the "Papriformer" types.

In the earlier development of the art of papermaking, the forerunner of the modern papermaking machine was known as the Fourdrinier machine which was a generally horizontal papermaking machine having a headbox which delivered the liquid paper pulp stock onto traveling screen through a slice in the headbox. The traveling screens or wire were generally supported first by a breast roll and then by various primary and secondary forming boards which were the prime removers of water from the paper stock. After passing over suction boxes, the wire and the paper stock then passed over a couch roll which served to drive the wires in the Fourdriner machine and also to remove more moisture from the paper stock prior to its being sent to the web pressing and drying portion of the papermaking process. For a comprehensive review of the Fourdrinier machine reference should be made to Volume III of the three-volume work entitled "Pulp and Paper Manufacture" prepared under the direction of the Joint Textbook Committee of the paper industry and edited by Ronald G. MacDonald and published by McGraw-Hill Company, copyright 1970 and bearing the Library of Congress catalog card No. 68-20994. The Fourdrinier papermaking machine is described in Chapter 6 of that volume starting on Page 245 and running through Page 295 with a detailed description of the couch roll being given on Page 286 and 287 of the same volume. As can be seen in FIG. 6-43 of that Volume on Page 287 the couch roll of a Fourdrinier machine generally comprises an outer shell which has a plurality of radial holes drilled therein with the holes being in contact with the inner portion of the couch roll which may be sectionalized to various vacuum or pressure sources.

PRIOR ART "PAPRIFORMER"

As the technology in papermaking advanced, various types of papermaking machines evolved which have been generally classified in cylinder-type machines and these are detailed in Chapter 7 of the same reference volume starting on Page 297 and running through Page 365. The cylinder-type papermaking machines are of many varieties. However, all are equipped with a couch roll at the end of the process which functions, in addition to other functions, to remove water from the paper stock prior to its being transferred to the next stage in the papermaking process. By referring to the reference volume on Page 337 at FIG. 7-32, there is shown one of the cylinder-type of papermaking machines known in the trade as the "Papriformer" and comprises basically a plurality of rolls described as a breast roll, a forming roll and a couch roll around which a top screen and a bottom screen are transported with a plurality of water collecting pans being formed in proximity to these rolls for the purpose of collecting the water extracted from the paper web which is formed between the traveling screens.

For a more detailed description of the "Papriformer," reference should be made to an article entitled the "The Papriformer Part I — The Machine and Its Performance" authored by R. de Montigny, I. T. Pye and T. B. Hedly as published in the "Pulp & Paper" Magazine of Canada; 68, No. 10; T-482-T-505 (October 1967). The forming roll in the "Papriformer" described comprises a generally two-zone vacuum section while the couch roll comprises a generally four-zone section with a positive pressure being induced in the first zone with an intermediate zone of atmospheric pressure being followed by two zones of vacuum as more detailed in the last cited reference article. It is known in the art to provide the forming rolls of the Papriformer and also the forming rolls of the other methods of papermaking with wire coverings which are used in conjunction with multi-zone vacuum zones for the purpose of extracting water from the traveling paper web with the vacuums in the multizones generally being low in the range of ten inches of water in order to draw large amounts of water into the forming roll for subsequent removal.

PRIOR ART "VERTI-FORMA"

Referring now to FIG. 1 of the drawings hereof, there is shown another variation of the conventional type papermaking machine known in the trade as the "Verti-Forma" and which comprises a pair of breast rolls 36 and 38 in combination with a couch roll 40 and a drive roll 52 with a pair of traveling wires 44 and 46 being utilized to contain the pulp stock 48 supplied by the headbox 50. A drive roll 42 carries the semi-formed paper, that is the wet paper web, 54 to the next stage in the paper forming process as is well known in the art. For a more detailed description of the Verti-Forma, reference should be made to the article entitled "Through A Glass, Darkly (A Discussion of New Sheet Formers)" by R. de Montigny in the "Pulp and Paper" Magazine of Canada, October 1966 issue.

When used in the "Verti-Forma," the couch roll 40 functions as a means to remove more water from the paper 54 as it passes around a portion of the periphery of the couch roll and attempts to discharge the water into a collector pan formed in proximity to the couch roll. As supplied from the manufacturer, the couch roll has formed therein a low vacuum zone and a high vacuum zone with the remaining portion of the couch roll interior being a void zone or a zone in which neither pressure nor vacuum was formed. The manufacturer's supplied couch roll also contained provision which allowed the low vacuum zone and the high vacuum zone to be rotated in the direction shown by the arrow (FIG. 2) within the void zone in order tha some control could be achieved over the discharge of the water from the periphery of the couch roll. The problem encountered with this couch roll design was that, while the collector pan collected some of the water thrown from the couch roll after the wire left the couch roll surface, a greater portion of the water would rim around the periphery of the couch roll as shown by the arrows and would not be collected by the collector pan but would be redeposited in an uneven pattern back on the wet upper web coming into contact initially with the couch roll. As a result of this condition, the couch roll was unable to remove sufficient water from the paper web causing the paper web to contain excess water which later caused excessive downtime in the production of the paper during a later stage of the papermaking process. The down times were caused by breaks in the paper web at the first press rolls downstream from the couch roll which resulted from the excess water being contained in the paper web. Before solving the problem with the invention of the Olinkraft patent, as described in the next section hereof, the number of breaks at the press rolls was running in the range of 20 per day requiring approximately 10 to 45 minutes apiece downtime before the problem could be corrected and the papermaking process started up again.

OLINKRAFT "SUCTION ROLL" System

In order to overcome the water problems inherent in the design of the prior art papermaking machines both of the Fourdrinier type and the cylinder type, there was provided in the preferred embodiment of the invention of the Olinkraft, U.S. Pat. No. 3,902,960 a new and novel couch roll and couch roll water removal system to precisely control the amount of water removed from the traveling paper web at the couch roll so that the amount of water in the paper web may be also precisely controlled. This was accomplished by forming a surface tension covering, such as a fine wire mesh screen, around at least a portion of the periphery of the couch roll and by precisely controlling the vacuum in the water control zone formed within the couch roll so that the surface tension covering and the vacuum control co-acted to cause the water to be held at the surface of the couch roll just prior to being released into the collector pan. The water control zone formed within the couch roll took the form of a multi-zone such as a three-zone system (water collection, transfer and release zones) of four-zone system (the latter including a final vacuum zone) as shown in the preferred embodiment hereof (FIG. 2). With the use of the surface tension covering on the couch roll in combination with the precisely controlled vacuum in the water control zone within the couch roll, a uniformly controlled pattern of water is thrown from the couch roll into the collector pan with the result that the rimming of water on the couch roll back in to the paper web was minimized, if not completely eliminated, depending upon the variation in the controlled vacuum in the water transfer zone and the final zone and also depending upon the amount of water and the manner in which it was held in the surface tension covering.

However, although pioneering and revolutionary in concept, it was found in the practice of the invention of the Olinkraft Pat. No. 3,902,960 with certain types of water and paper stock and over a period of time fines buildup (plugging) occurred in the wire mesh surface tension covering on the couch roll. This plugging of the wire mesh covering with pulp fines under these conditions prevented sustained operation of the couch roll for long periods of time.

The problem of fines buildup was believed to be due to varying levels of water removal by the couch roll from essentially zero to a significant amount (of the order of 100 gpm) as a result of the normal variation in the dewatering characteristics of the stock (pulp) used on the paper machine. During periods of low water removal, pulp fines (fibers, etc.) were pulled into the couch wire covering, gradually building up and plugging the wire openings over a period of several days. This plugging appeared to occur within 2 to 3 days after a new wire was put on the couch roll.

Thus during these periods of low water removal, fiber fines were drawn into the couch roll wire covering by the applied vacuum of the interior zones and became inter-twined in the couch roll covering, plugging the open areas of the wire. Eventually, the wire would become completely plugged so no water could be removed by the couch roll. Additionally, even incomplete plugging of the wire also caused wet streaks in the paper web causing other operational problems.

The present invention is directed to overcoming and solving these problems by inter alia utilizing a pressure roll in combination with the multi-zone/surface tension covering couch roll, and thereby permitting the great water control results of the multi-zone/surface tension covering combination to be successfully used in the papermaking process under all water and paper stock conditions.

COUCH PRESSURE ROLLS

Couch pressure rolls are generally given only cursory treatment in most papermaking textbooks with most explanations limited to less than one page. Exemplary of prior art text references are *Pulp and Paper Manufacture,* Vol. 3, "Manufacture & Testing of Paper And Board," J. N. Stephenson, 1953, pp. 144–145; and *Foudrinier Papermaking,* Gunnar Gavelin, 1963, pp. 107–108.

Stephenson states that the "couch presser roll is used . . . to seal the sheet to the couch, to reduce [air] leakage, and to raise the vacuum, and as a result to increase the water removal. It also increases sheet consolidation, reduces the number of lumps, and reduces the number of wet end breaks."

Gavelin states that in locating a couch presser roll that it should "be placed as early on the suction zone as possible without sheet crushing. Some air leakage through the sheet ahead of the nip is necessary to avoid flooding of it."

Pressure roll coverings and roll sizes are also discussed in these articles.

SUMMARY OF THE PRESENT INVENTION

In combination with the multi-zone/surface tension covering there is included in the present invention a pressure roll located near the beginning of the water collection or removal zone of the couch roll in face-to-face pressure engagement therewith through the intervening paper stock (note FIG. 5 hereof).

The main objective of the present invention is to decrease the plugging tendency of the couch roll wire cover.

In actual tests of the present invention in actual papermaking operations, a first wire mesh couch roll surface tension covering of a 40 × 50 mesh bronze wire lasted approximately three weeks before it had to be changed due to fines plugging the openings. A second wire of ∓× 40 stainless steel mesh was used approximately 6 weeks and did not show any significant amount of plugging. This is in contrast to the previous use of 40 × 50 mesh bronze and 36 × 40 mesh bronze wires which became plugged with fiber fines in approximately three days without the pressure roll.

The present invention achieves this main objective of plugging prevention, it is believed, by inter alia increasing the water removal capacity of the couch roll. In actual use of the present invention, it has been observed that the dewatering capacity of the couch has been significantly increased. This was observed by moving the pressure roll away from the couch and noting a visual decrease in the amount of water dicharged into the couch saveall pan. When the pressure roll was brought back against the couch, the water discharged into the pan was visually increased. This increased dewatering capacity also allows the operator of the papermaking machine to back out on the standard deflectors (note elements 90 of FIG. 1), eliminating many wet streaks.

It is speculated that, with a generally higher water removal capacity, fiber fines are flushed continuously from the couch wire covering with the water discharge, resulting in a longer time before wire plugging would occur to hamper machine operation.

Additionally the pressure roll serves to compact the wet paper stock or web in the pressure roll/couch nip. Based on a study thereof it is estimated that the wet web is compacted in the nip to between one-half and one-third of its original thickness before the couch (note wet paper web 54 of FIG. 5).

Finally, with the use of the pressure roll in the present invention a great increase in the vacuum level in the water collection or removal zone is achieved without a change in any of the other couch roll parameters. With the installation of the pressure roll in one demonstration there was an increase in the initial, water collection zone of the couch from the theretofore eight-to-ten inches of mercury (8–10 inches Hg) to about 16 inches of mercury (16 inches Hg), which represents a 60 to 100 percent (60–100%) increase.

In summary then, the pressure roll in the combination of the multi-zone/surface tension suction roll of the present invention, in addition to the basic objective of preventing the plugging of the surface tension covering, has the three following secondary features:

a. it acts as a pressure nip to assist generally in dewatering the web at the couch, enabling the couch to take away more water;

b. it compacts the web in thickness, making a tighter and stronger web as the web leaves the couch; and c. it helps seal the web to the couch, thereby increasing the vacuum level in the water collection (dewatering) zone.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein:

FIG. 1 is a schematic diagram of a side view of the paperformer known in the prior art as the "Verti-Forma" with a pressure roll applied thereto in the lower, couch roll area in accordance with the present invention; while

FIG. 3 is a front view of the roller element of the pressure roll of FIGS. 1 and 2; while

DESCRIPTION OF THE PREFERRED EMBODIMENTS

Introduction

Figure 1:
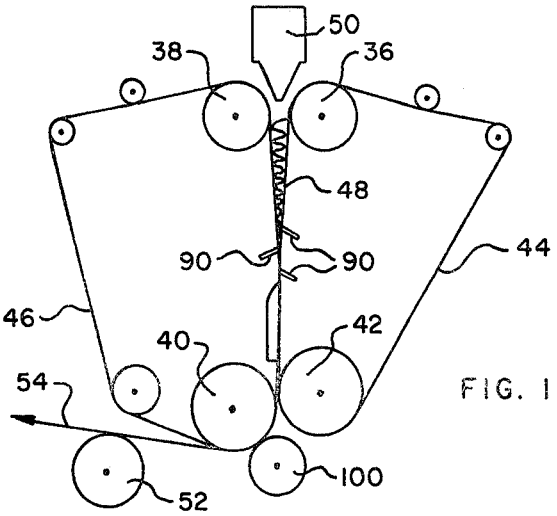
Figure 2:
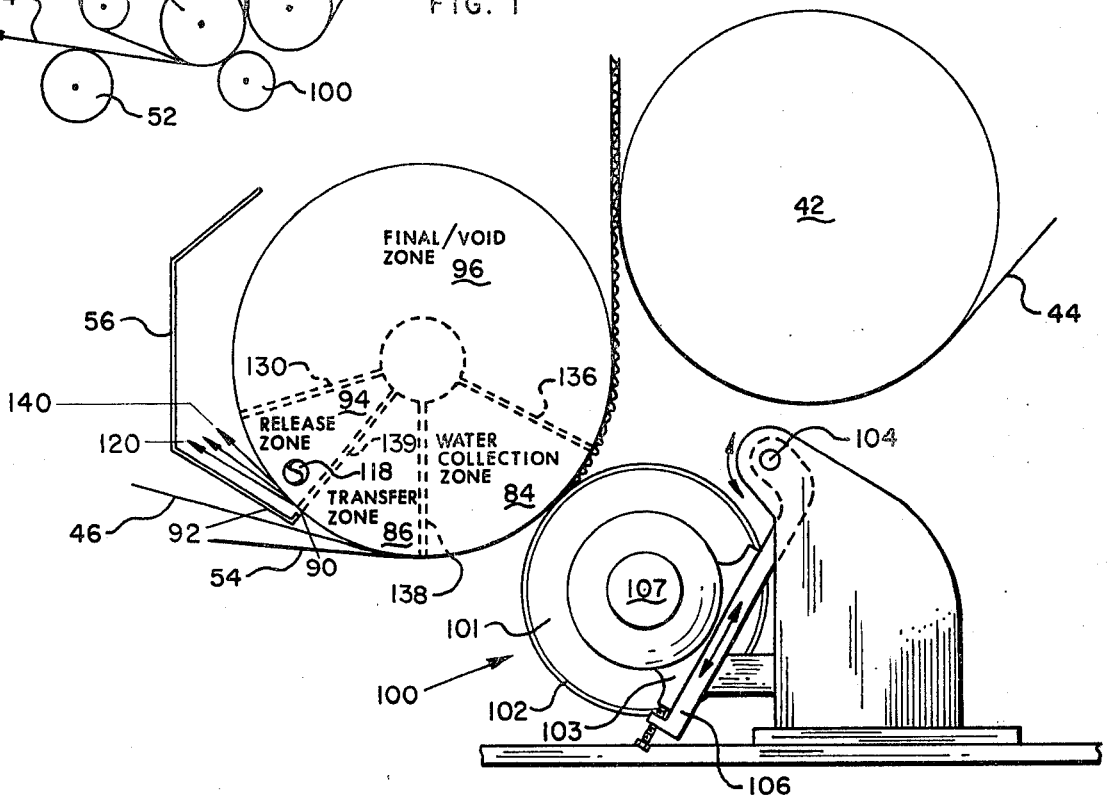
FIG. 2 is an enlarged, side view of the couch roll/-pressure roll area of the "Verti-Forma" shown in FIG. 1, with the interior zones of the couch roll being shown in phantom line.
Figure 4:
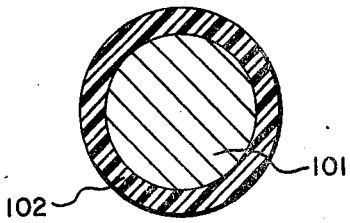
FIG. 4 is a side cross-sectional view thereof taken along section lines 4—4 of FIG. 3.
Figure 5:
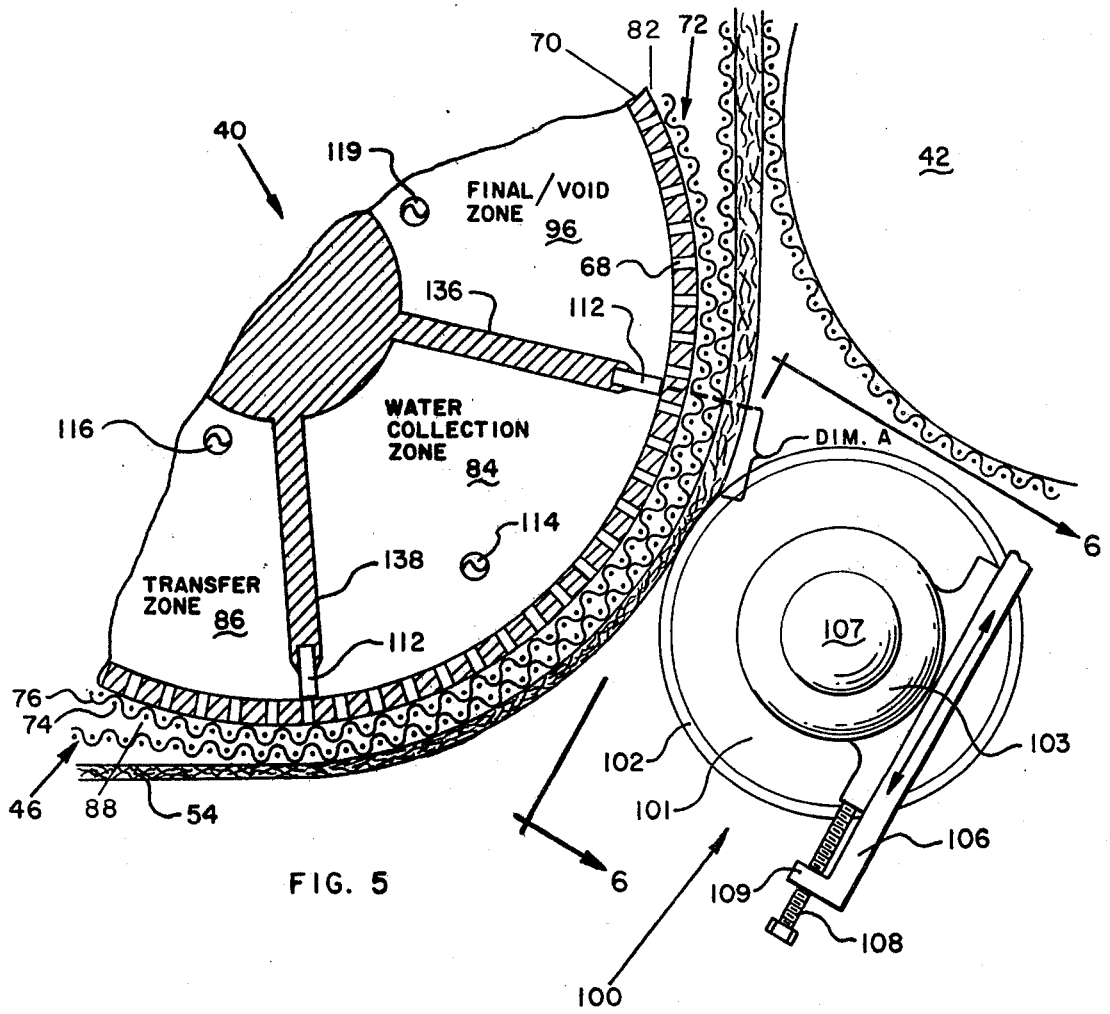
FIG. 5 is a further enlarged, side, partial view of the couch roll/pressure roll area of FIGS. 1 and 2, partially in cross-section to show the interior structure of the couch roll.
Figure 6:
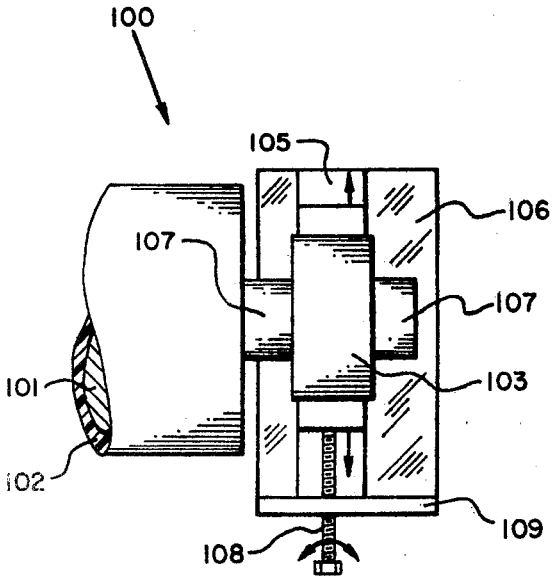
FIG. 6 is a head-on, partial view of one of the end portions of the pressure roll, taken from the perspective of perspective lines 6—6 of FIG. 5.

Referring now to the drawings in general and in particular to FIGS. 1, 2 and 5 of the drawings, there is shown as the preferred embodiment of the present invention the modifications that have been made to a couch roll with the inclusion of the pressure roll as the preferred and most efficacious application of the present invention, whereby an enhancement of the unusual results described herein has been obtained. The couch roll modifications, viz. the surface tension covering and the various interior pressure zones, will first be detailed in association with FIGS. 2 and 5 and then the pressure roll will be discussed in detail with primary reference to FIGS. 3–6.

Surface Tension Covering

It has been found that one necessary element needed to control the discharge pattern of water from the couch roll is to provide the couch roll or at least a portion of the couch roll with a surface covering capable of acting as a surface tension member. The surface tension covering provided should contain holes, grids or other openings to allow water to move into and out of the existing holes 68 drilled in the couch roll shell 70 as shown in the drawings. However, the holes, grids or other openings should be of a size that would allow a film-forming action to take place between it and the water in the manner to be described more fully hereinafter and may be formed for example of available metallic or non-metallic wire screens having a varying wire mesh which are readily available to the paper industry. Although the mechanism of the surface tension covering may not be fully understood, it is believed to act as a restraining partition and a surface on which the water "rides" as it passes through the transfer zone 86 and final/void zone 96, as described more fully hereinafter. This film-forming action is similar to what one might observe when a static window screen is sprayed with water — some water is trapped in the openings of the screen by a surface tension phenomenon.

These couch roll coverings could comprise a single layer of mesh 72 formed generally by a plurality of wires 74 interwoven with a plurality of other wires 76 to produce a wire mesh screen of the type similar in structural appearance to that used in a household screen door, as illustrated as the preferred embodiment in FIG. 5. On the other hand, as a variation on the surface tension covering, the screen 72 may be formed by fixedly attaching a top screen to a bottom screen (not illustrated) with the screens being fixedly attached either to each other or to the surface 82 of the couch roll shell 70.

Other variations of the surface tension covering may be utilized without departing from the spirit and scope of the invention. For example the surface tension covering may be formed by utilizing lands and grooves machined on an existing couch roll or may be formed by etching the couch roll and may also be formed by fixedly attaching a wire or wires over at least the existing openings 68 in the couch roll leaving the remaining portion of the couch roll uncovered. Still other variations in the surface tension member may comprise providing spirals or grooves in the couch roll shell with a surface tension member being formed at least over the sprials or grooves.

Water Control Zone Generally

As beforementioned in addition to the use of a surface tension covering around at least a portion of the periphery of the couch roll, the new and novel suction roll and water removal system of the invention comprises a unique water control zone which will now be described in more detail. In the preferred embodiment shown by this disclosure, it has been found that the preferred internal arrangement of the couch roll should provide for at least three or four sub-zones or sections which are separately controllable for the purpose of being able to directionally control the discharge of water from the couch roll. In describing the water control zone and its elemental parts, it should be understood that "zone," "sub-zone" and "section" are usually used interchangeably.

Water Collection Zone

The first of the water control zones can generally be referred to as water collection zone 84 which should be a relatively high vacuum zone ranging from approximately 5 inches of mercury to approximately twelve or more inches of mercury. Indeed, for example, a vacuum level of fifteen or twenty inches of mercury could be used. The water collection zone may preferably encompass as much of the area of the couch in direct contact with the drainage wires 46 and the wet paper web 54 as possible. However, a lesser portion of this same area may perhaps be satisfactory, as this would result in less time for de-watering of the wet paper web 54 by the couch roll.

It is conceivable that many vacuum ranges could be utilized in the water collection zone 84, and for the purposes of this application the high vacuum induced in the water collection zone can probably be defined as any vacuum greater than approximately 2 inches of mercury which is equivalent to approximately 25 inches of water. While an experimental pilot plant operation utilized high vacuums of two to seven inches of mercury, it is conceivable that a production unit should work mainly between the vacuum range of approximately 5 and approximately 12 inches of mercury or more in the water collection zone 84. It should be noted that the higher the vacuum in the water collection zone 84, the greater the capacity of the radial holes 68 in the couch (couch roll openings) in combination with the surface tension member to remove the water for later discharge as will be more fully described hereinafter. Accordingly, it is foreseeable that high vacuums of up to approximately twenty-eight inches of mercury might be desirable in some instances in the papermaking process.

In the operation of most couches in the papermaking process, it is desirable to pull some air through the paper web to assure maximum web dryness and this could be done in the high vacuum water collection zone if possible. It should also be noted that this accompaniment of air with the water removal in the water collection zone further distinguishes the operation of the most preferred couch roll embodiment from that of a forming roll which does not pull air on the vacuum forming roll but only pulls water through the couch roll.

Transfer Zone

Immediately following the water collection zone in the preferred embodiment is a transfer or transition zone 86 which has formed therein a relatively small vacuum in comparision to the magnitude of the vacuum being formed in the water collection zone. From experimentation it has been found that, whenever the vacuum in the water collection zone 84 ranges from approximately five to approximately 12 inches of mercury, then the preferred vacuum in the transfer zone 86 would range from approximately zero inches of water to approximately 10 inches of water.

The transfer zone 86 acts as a transition zone to prevent the early discharge of water from the couch roll as the wire 46 is separated from the couch roll at the point 88 as shown in FIG. 5 of the drawings. Therefore it is preferable that the transfer zone 86 initiate approximately in the area of the paper stock leaving the couch roll as shown by the numeral 88 in the drawing and terminate somewhere in the vicinity of the beginning of the collector means as shown by the numeral 90 in FIG. 2. It is possible to locate the start of the transfer zone 86 at a point prior to the point of departure of the wire 46 from the couch roll, however, it is probably not desirable to locate it after the point of the wire and paper separation since this would allow extraneous air to be drawn from the ends of the couch roll into the high vacuum water collection zone 84. The end of the transfer zone 86 should be located at a position such that the subsequent water release pattern clearly enters the water collection pan 56 without impinging on the lip 92 of the collector pan. It is inter alia within the transfer zone 86 that the surface tension covering applied to the couch roll exhibits its importance since it acts as a surface tension member on which the water in the couch roll holes 68, previously removed by the high vacuum zone, are re-deposited in the surface tension member in a film-like manner. The openings in the couch roll covering fill with water according to the size of the openings in the couch roll covering and the surface tension of the water. While normally the water in the surface tension member would tend to be discharged from the couch while passing through the transfer zone 86 as a result of the centrifugal force created by the rotation of the couch, with the low vacuum applied from within the transfer zone 86, this centrifugal force is overcome and the water remains on the surface tension member and possibly within the openings 68 in the couch roll shell 70 until it is released as the couch roll shell 70 passes through the third or release zone of the multi-zone system.

In experimental work performed on a test unit, vacuums in the transfer zone ranging from approximately 0 to approximately 10 inches of water have given satisfactory results with the best results appearing to be between about 2 and about 5 inches of water for pilot plant conditions. It is foreseeable that higher vacuums may be expected at higher operating speeds of a paperforming machine, ranging from 1500 to 3000 feet per minute, and with higher volumes of water than possible on the pilot plant model.

Release Zone

Immediately following the transfer zone 86 is the third zone of the preferred embodiment multi-zone system wherein there is formed a release zone 94 which, as the name implies, is the zone in which the water is released from the surface tension covering and from the couch roll openings 68. This zone 94 follows the low vacuum transfer zone 86 and appears to work satisfactory when vented to the atmosphere with a vent of sufficient size that air enters the release zone 94 naturally as designated by the amount of water discharged from the couch. Test experiments also indicate that the release zone 94 may also work at certain conditions of vacuum and pressure but these conditions do not appear ciritical in relationship to the air vented condition. In the release zone 94, the surface tension covering again becomes of significance to the operation of the zone in that it controls the water discharge pattern. As the vacuum on the film-like collection of water developed in the transfer zone 86 is broken as the couch shell 70 passes into this zone, the water is discharged from and through the surface tension covering rapidly because of the water's close proximity to the surface of the couch roll.

Final/Void Zone

It is believed that a residual amount of water is carried in the couch roll openings 68 while the couch roll passes over the void zone 96 in an equilibrium state and the surface tension covering acts to retard further discharge of this equilibrium water by acting as a barrier and by retaining any water thus collected through new surface tension forces which are relatively large for the small droplets of water. It is thought that this action also tends to prevent the rimming of the water as beformentioned on the outer surface of the couch roll and into the incoming paper web.

It should also be pointed out that numerous variations of the physical vacuum zone arrangements are conceivable to obtain a desired and controllable water release pattern with possible improvements thereon. For example, some experiments have shown that the void zone 96 may function by being vented to the atmosphere or, vented to the release zone 94 through a valved opening or by removing the seal in the wall between the two zones.

In addition, the void zone 96 may be made into a fourth or final vacuum zone in which any vacuum may be used which is sufficient to prevent discharge of the aformentioned residual water. A vacuum level range of approximately 2 to 4 inches of water should be generally adequate. This variation, in which the void zone 96 is made a fourth or final vacuum zone appears to offer an even more significant improvement in the operation of the couch in that a more concise water discharge pattern may be obtained with lesser requirements on the transfer vacuum zone control.

It is noted that, as illustrated in FIG. 2 and 5, the void or final zone 96 extends from the termination of the release zone 94 to the initiation of the water collection zone 84, the four zones spanning the full 360 ° of the roll.

Zones Generally

As beforementioned, the water control zone in the preferred embodiment may be formed as a three-zone system incorporating a water collection zone 84, a transfer zone 86 and a release zone 94, and may also be preferably formed as a four-zone system as beforementioned. It has been found from experimentation that by varying the relatively low vacuum in the transfer zone 86, the operator is able to precisely control the pattern of the water throw off from the couch roll into the collector pan 56. Whenever the low vacuum in the transfer zone 86 is in the low range the pattern can be precisely controlled to that shown by the arrow 120; and, when the low vacuum in the transfer zone is in the high range, the water pattern can be varied to that shown by the pattern shown in arrow 140 since it takes longer to release this higher vacuum as the shell 70 of the couch passes into the release zone 94.

In the formation of the multi-zone water control zone of the invention, the water collection zone 84 is formed by means of a pair of walls 106 and 108, with the wall 108 also forming one wall of the transfer zone 86 with the second wall of the transfer zone 86 being formed by the wall 110, all in a manner well known in the art. The walls 150, 136, 138, and 139 all have formed at the exterior portion thereof a seal 112, as is well known in the art of couch roll design.

As shown schematically in FIGS. 2 and 5, the relatively high vacuum formed in the water collection zone 84 is induced by the vacuum opening 114 while the relatively low vacuum formed in the transfer zone 86 is induced through the vacuum opening 116 as is well known in the art. As beforementioned, the vent in the release zone 94 is induced by means of the opening 118, while the void zone 96 can be vented as aforedescribed or become a final vacuum zone induced through vacuum opening 119.

When the water control zone is formed in other than a three or four zone system as taught by the most preferred embodiments, it is within the spirit and scope of the invention that the pressure in the water control zone could be varied by other means so as to be able to directionally control the flow of water off the couch roll in any pre-determined pattern for deposit in the water collecting pan. For example the water control zone could comprise at least two zones with the pressure income zone being a variable vacuum sufficient to counteract the centrifugal effects of the rotation of the couch roll, while the pressure in the other zone is variable to release the water thereby allowing the centrifugal action of the couch roll on the water to pull the water from the surface tension member and into the collector means with the couch roll being covered with the aforementioned surface tension covering.

When practicing the method of the preferred embodiment, first the exterior surface of the couch roll is provided with a surface tension covering of the type or types beforementiond and thereafter the web is passed over the water control zone in the couch roll while inducing a pre-determined vacuum in the water control zone. The water control zone may be a one, two, three, four or other multi-zone system within the spirit and scope of the invention, and after the web is passed over the water collection zone the vacuum in the water control zone will be reduced to a much lesser vacuum sufficient to hold the water in the surface tension covering against the centrifugal effects caused by the rotation of the couch roll. Thereafter the pressure in the water control zone is reduced to a pressure sufficient to allow the water held in the surface tension cover to be released in a controllable pattern as a result of the centrifugal force caused by the rotational effect of the couch roll to thereby allow the water to be collected in the collector pan. Any residual water may be retained in the couch roll openings by the surface tension member as the couch shell passes over the void or final zone.

It is noted that various other test data and additional examples of suitable surface tension coverings and specific mesh sizes and vacuum and pressure levels are discussed in the Olinkraft U.S. Pat. No. 3,902,960 particularly in the section entitled "Additional Test Data." Various further exemplary modifications of the embodiments of the couch or suction roll element itself are further brought out in the Olinkraft U.S. Pat. No. 3,902,960 especially in the section entitled "Other Variations," and the entire disclosure thereof is incorporated herein for further disclosure purposes.

Pressure Roll

As shown in FIGS. 1 and 5 in combination with the over-all "Verti-Forma" papermaking machine, a pressure roll 100 is included in pressure, face-to-face engagement in parallel with the couch roll 40 near the drive roll 42 for the primary purpose of preventing or at least retarding the plugging of the interstices of the mesh 72 with pulp fines, etc.

As further shown in FIGS. 2 and 5, the pressure nip between the couch roll 40 and the pressure roll 100 occurs at the water collection zone at an area removed from the location of the initial wall 106 by a distance denominated in FIG. 5 as "DIM.A." The distance for "DIM.A" has been found to be preferably of the range of 1 to 1½ inches and allows for some vacuum to be applied to the wet paper web 54 before the pressure of the pressure roll, thereby preventing crushing of the wet paper web. The nib area itself is typically of the order of 2 inches across the rolls.

Figure 3:
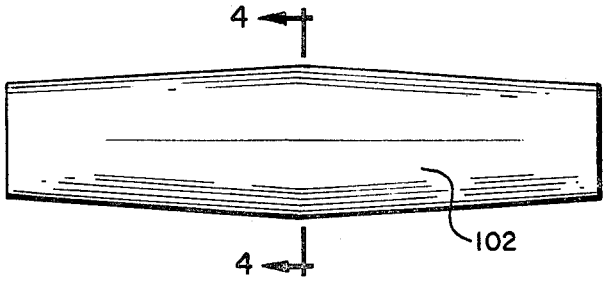

As best shown in FIG. 4 the roller element of the pressure roll 100 comprises a basic inner body or core 101 of for example iron having an outer solid, smooth surface layer 102 of very soft rubber and of the release type, self-skinning rubber. As best shown in FIG. 3, the roller element is preferably peaked at its center, the crown of which is sized according to the pressures and weight involved or the bending moment of the roll. From the center crown, the pressure roller element forms a smooth surface of progressively diminishing diameter to its ends.

Typical dimensions of the roller element are as follows:

roller length: 189 inches
roller diameter: 20 inches
roller peak: 50/1000 crown (1/1000) crown
thickness of rubber layer at end of roller: 1.5 inches
rubber softness 60 P & J (190–200 P & J)

The pressure roller is mounted at each of its ends on a structure which allows it to be rotated about pivot point 104 (note double-headed curved arrow in FIG. 2) into and out of engagement with the couch roll 40 and moved laterally with respect to the couch roll surface (note double-headed straight arrow in FIGS. 2, 5 and 6) to vary the area of pressure nip contact, and hence "DIM.A." As to the latter movement, it should be noted that the ends 107 of the pressure roll 100 are supported in brackets 103 which sit in tracks 105 in the mounting arms 106. As the screw 108 which is threaded in the abutment 109 is rotated, the brackets 103 move in the tracks 105, thereby adjusting the relative lateral position of the pressure nip between the rolls.

The pressure roll 100 is placed in face-to-face, pressure engagement against the couch roll 40 by means of the soft rubber covering 102 bearing against the wet paper web 54 which is being carried by the wire 46 passing over the screened couch roll surface 82. A typical bearing pressure for the embodiment detailed above is 45 to 48 psig, with a usual maximum of 50 psig.

As brought out in greater detail in the "Summary of the Present Invention" hereof, the pressure roll 100 in combination with the multi-zone/surface tension covering structure of the couch roll 40 enhances the water removal and watere control action of the couch roll by inter alia enhancing the vacuum characteristics and increased dewatering in the water collection zone 84 of the couch, resulting in a greater flushing action of the paper stock fines from the interstices of the wire mesh screen 72. This flushing action counteracts the natural tendency of the pulp fines to plug up the mesh and deteriorate the water removal and water control action of the couch.

From the above it becomes apparent that there has been provided by the subject disclosure a new and unique suction roll and suction roll water removal system for the papermaking process, having particular application to couch rolls, wherein water is removed from the wet web and is subsequently discharged in a controllable manner which is non-distributive to the rest of the papermaking process. The water is removed from the wet paper web in a high vacuum zone ranging from approximately two to approximately 28 inches of mercury passing through a surface tension covering formed on at least a portion of the couch roll and is entrapped partially in the holes in the couch roll and in the surface area of the surface tension covering. In the transfer zone a momentary state of equilibrium is obtained in which the vacuum and the surface tension forces counteract the centrifugal forces developed by the rotation of the couch roll to maintain the water in the surface tension covering and near the surface of the couch roll within the couch roll openings. This is followed by a rapid discharge of the water into the collector pan in a manner and pattern which is determined by the location of the release or discharge zone and the surface tension member in relationship to the collector pan. Any residual water remains in the couch roll openings by being retained there by the surface tension covering, as the couch roll shell passes over the void area or, alternatively over the fourth or final vacuum zone. Finally, a pressure roll is provided to counteract the natural action of the pulp fines from plugging up the surface tension covering, allowing the multi-zone/surface tension structure of the couch to continue its action over sustained periods of time.

From the foregoing, it can be seen that there has been provided a new and unique improvement in the papermaking industry which is capable of extracting large quantities of water from the traveling web as it passes over the couch roll or other type of suction roll and which accomplishes all of the objects and advantages hereinbefore outlined. From a reading of the foregoing specification and a study of the attached drawings, it should become apparent that many changes in the details of construction and arrangement of the steps of the method may be made without departing from the spirit and scope of the invention as expressed in the accompanying claims and the invention is not to be limited to the exact manner shown and described, as the preferred embodiments have been given by way of illustration only. Thus, for example, more and/or varied vacuum zones could be provided.

What is claimed as invention is:

1. In a papermaking process of the type wherein water is removed from paper that is being run over a suction roll, such as for example a couch roll, the improvement comprising the following steps:

(a) providing the suction roll with a water control zone comprising a water collection section, a transfer section and a release section;

(b) providing on at least a portion of the suction roll a wire mesh surface tension covering around the periphery thereof;

(c) applying a vacuum in the water collection section;

(d) applying a relatively small vacuum in the transfer section in comparison to the magnitude of the vacuum being utilized in the water collection section, said wire mesh surface tension covering and the vacuum differential between the vacuum in the transfer section and the vacuum in the water collection section coacting to cause the water to be held at the surface of the suction roll just prior to the release section so that it can be released in a controlled pattern; and (e) providing a pressure roll in face-to-face pressure engagement against the paper with the suction roll at an area within said water collection section; whereby the natural tendency of fines from the paper to plug up said wire mesh surface tension covering is counteracted.

2. The improvement as defined in claim 1 wherein in step (b) said surface tension covering is provided by fixedly attaching at least one wire mesh screen to the outer surface of the suction roll; and in step (e) the pressure roll is provided so that the pressure nip between the rolls is located approximately an inch to an inch-and-a-half from the beginning of said water collection section.

3. A water control zone and removal system for a multi-zone couch roll for a papermaking process, the couch roll being of the type having a plurality of radial openings formed in the exterior shell of the roll and having a collector pan for collecting water that is thrown from the roll, comprising:

a wire mesh surface tension covering at the surface of the couch roll at least covering the radial openings in the exterior of the shell of the roll, said wire mesh surface tension covering allowing a film-forming action to take place between it and the water from a wet paper web;

transfer zone means for forming a transfer zone within the couch roll at a pre-determined location initiating at a point approximately where the paper web leaves the roll and terminating approximately at the collector pan;

transfer zone vacuum means for creating a minimal controlled vacuum within the transfer zone for holding the water on the wire mesh surface tension covering in a film-like collection of water and in the couch roll openings at or near the surface of the couch roll shell against the centrifugal force tending to pull the water off the roll so that whenever the minimal vacuum is subsequently released the retained water will be thrown off the couch roll in a controlled directional pattern into the collector pan;

a final zone means for forming a final vacuum zone within the couch roll at a pre-determined location initiating at the point approximately at the end of the collector pan and terminating approximately where the paper web contacts the roll;

final zone vacuum means for creating a controlled vacuum within the final zone for holding any residual water on the surface tension covering in a film-like collection of water and in the couch roll openings against the centrifugal force tending to pull the residual water off the roll or cause the residual water to rim along the roll so that the residual water will not be thrown onto an incoming paper web;

release zone means for forming a water release or discharge zone within the couch roll at a pre-determined location initiating at the termination of said transfer zone means and terminating at the initiation of said final zone means;

release zone pressure means for creating a pressure within the release zone at a level higher than that in a water collection zone, the transfer zone or the final zone for discharging the water theretofore held at or near the surface of the couch roll shell in a controlled directional pattern into the collector pan;

water collection zone means for forming a water collection zone within the couch roll at a pre-determined location initiating at the termination of said final zone means and terminating at the initiation of said transfer zone means;

water collection zone vacuum means for creating a controlled vacuum within the water collection zone at a pressure level lower than that in either the transfer zone or the final zone for drawing water from the wet paper web; and pressure roll means in face-to-face, pressure engagement with the exterior of the couch roll at a point within said water collection zone means for counteracting the natural tendency of fines, or other small materials from the wet paper web from plugging up said surface tension covering.

4. The system of claim 3 wherein said nip engagement is positioned approximately a ½ to an 1½ from the beginning of said first zone.

5. The system of claim 3 wherein the surface of said pressure roll is solid.

6. The system of claim 5 wherein said pressure roll is comprised of a solid rigid core carrying a surface covering of resilient material.

7. The system of claim 6 wherein said resilient material is a release type self-skinning rubber.

8. The system of claim 3 wherein the outer operative surface of said pressure roller is crowned at its center and forms a smooth, diminishing diameter surface toward its ends.

9. A method for improving the removal of water in a papermaking process wherein a traveling paper web is subjected to various pressures induced from within a rotating suction roll, such as for example a couch roll, in order to remove the water from the roll to a collector pan positioned in proximity to the suction roll, comprising the steps of:

(a) providing the exterior surface of the suction roll with a wire mesh surface tension covering and providing the suction roll with a water control zone;

(b) passing the web over the water control zone in the suction roll while inducing a predetermined vacuum of a relatively low, less-than-atmospheric pressure level in the water control zone;

(c) raising the pressure level in the water control zone to a higher pressure level but still less than atmospheric pressure and sufficient to hold the water in the surface tension member against the centrifugal effect caused by the rotation of the suction roll;

(d) further raising the pressure level in the water control zone to a higher level sufficient to allow the water held in the surface tension member to be released in a controllable pattern by the centrifugal force caused by the rotational effect of the suction roll thereby allowing the water to be collected in the collector pan; steps "b," "c" and "d" being performed sequentially with respect to the circumference of the suction roll; and (e) providing a pressure roll in face-to-face, pressure engagement with the exterior surface of the suction roll to counteract the natural tendency of the fines and other substances from the paper web to plug up the surface tension covering.

10. The method as defined in claim 9 wherein in step (a) said surface tension cover is provided by forming a wire mesh screen around the exterior surface of the suction roll.

11. The method as defined in claim 9 wherein in inducing the vacuum in step (b) the vacuum is induced in a range from approximately five to approximately fourteen inches of mercury.

12. The method as defined in claim 9 wherein in raising the pressure level in step (c) the pressure is raised to a range from approximately zero to approximately twelve inches of water.

13. The method as defined in claim 9 wherein, in further raising the pressure level in step (d), the pressure is raised to approximately atmospheric pressure.

14. The method as defined in claim 9 further comprising the step of:

(e) decreasing the pressure level in the water control zone to a pressure sufficient to retain any residual water, not released in step (d), in the suction roll.

15. In a suction roll, such as for example a couch roll, of the type used in the papermaking process in conjunction with an exterior water collecting means and having a plurality of radial openings formed in the exterior of the suction roll and also having vacuum means within the suction roll for control of water removed from the paper in the papermaking process to the suction roll openings, the improvement comprising:

(a) a wire mesh surface tension covering covering at least a portion of the suction roll, said wire mesh surface tension covering allowing a film-forming action to take place between it and the water from a wet paper web, said surface tension covering serving as a means to aid in the removal of water from the wet paper web by forming a film-like collection of water and in the subsequent discharge of the removed water into the exterior collecting means, said surface tension covering also serving to retain any undischarged residual water in the radial openings formed in the exterior of the suction roll by forming a film-like collection of water until it can be subsequently discharged by manipulation of the vacuum means; and (b) a pressure roll in face-to-face, pressure engagement with the exterior surface of the suction roll, said pressure roll serving as a means to counteract the tendency of the fines and other substances from the paper from plugging up said wire mesh surface tension covering.

16. In a papermaking process of the type wherein water is removed from paper that is being run over a suction roll, such as for example a couch roll, the improvement comprising the following steps:

(a) providing a suction roll with a vacuum means for removing water;

(b) providing a wire mesh surface tension covering covering at least a portion of the suction roll, said wire mesh surface tension covering allowing a film-forming action to take place between it and the water from a wet paper web;

(c) providing a pressure roll in face-to-face, pressure engagement with the exterior surface of the suction roll, said pressure roll serving as a means to counteract the tendency of the fines and other substances from the paper from plugging up said wire mesh surface tension covering.

17. The improvement as defined in claim 16 wherein in step (a) said vacuum means is provided by providing the suction roll with a water control zone comprising a water collection section under a vacuum, a transfer section with a relatively small vacuum in comparison to the magnitude of the vacuum being utilized in the water collection section and a release section.

18. The improvement in claim 17, wherein in step (c) the pressure roll is provided so that the pressure nip between the suction roll and the pressure roll is located approximately an ½ to an 1½ from the beginning of said water collection section.

* * * * *